US011757176B2

(12) United States Patent
Chuang et al.

(10) Patent No.: US 11,757,176 B2
(45) Date of Patent: Sep. 12, 2023

(54) ANTENNA STRUCTURE AND ELECTRONIC DEVICE

(71) Applicant: Wistron Corp., New Taipei (TW)

(72) Inventors: Shih Ming Chuang, New Taipei (TW); Lung-Fai Tuen, New Taipei (TW); Pei-Cheng Hu, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 17/521,547

(22) Filed: Nov. 8, 2021

(65) Prior Publication Data

US 2023/0115428 A1 Apr. 13, 2023

(30) Foreign Application Priority Data

Oct. 7, 2021 (TW) ..... 110137309

(51) Int. Cl.

| | |
|---|---|
| ***H01Q 1/24*** | (2006.01) |
| ***H01Q 5/30*** | (2015.01) |
| ***H01Q 1/36*** | (2006.01) |
| ***H01Q 5/371*** | (2015.01) |
| ***H01Q 9/04*** | (2006.01) |

(52) U.S. Cl.

CPC ..... *H01Q 1/36* (2013.01); *H01Q 1/243* (2013.01); *H01Q 5/371* (2015.01); *H01Q 9/045* (2013.01)

(58) Field of Classification Search

CPC ..... H01Q 1/24; H01Q 1/241; H01Q 1/243; H01Q 1/38; H01Q 5/31; H01Q 5/314; H01Q 5/35; H01Q 1/48; H01Q 5/42; H01Q 9/26; H01Q 9/42; H01Q 1/36; H01Q 5/30

See application file for complete search history.

(56) References Cited

U.S. PATENT DOCUMENTS 11,038,254 B2 * 6/2021 Chang ..... H01Q 5/30
11,128,050 B1 * 9/2021 Chuang ..... H01Q 5/371

(Continued)

FOREIGN PATENT DOCUMENTS

CN 101714690 B 7/2013
CN 108767448 A 11/2018

(Continued)

OTHER PUBLICATIONS

Extended European Search Report dated Jun. 14, 2022, issued in application No. EP 21216763.9.

(Continued)

*Primary Examiner* — Thai Pham

(74) *Attorney, Agent, or Firm* — McClure, Qualey & Rodack, LLP

(57) ABSTRACT

An antenna structure includes a first radiation element, a second radiation element, a third radiation element, a fourth radiation element, and a fifth radiation element. The first radiation element has a feeding point. The second radiation element is coupled to the feeding point. The second radiation element is at least partially surrounded by the first radiation element. The third radiation element is coupled to a ground voltage. The fourth radiation element is coupled to the third radiation element. The fifth radiation element is coupled to the third radiation element. The fifth radiation element is at least partially surrounded by the third radiation element and the fourth radiation element.

16 Claims, 4 Drawing Sheets

(56) References Cited

U.S. PATENT DOCUMENTS

| | | | | |
|---|---|---|---|---|
| 2006/0022888 | A1* | 2/2006 | Cheng | H01Q 5/371 343/795 |
| 2015/0061952 | A1* | 3/2015 | Chiang | H01Q 9/42 343/749 |
| 2016/0294048 | A1* | 10/2016 | Xu | H01Q 1/2291 |
| 2019/0198975 | A1* | 6/2019 | Chen | H01Q 9/42 |
| 2021/0066801 | A1* | 3/2021 | Tsai | H01Q 5/385 |
| 2021/0126343 | A1* | 4/2021 | Chang | H01Q 5/335 |
| 2021/0167499 | A1* | 6/2021 | Tseng | H01Q 5/385 |
| 2022/0190465 | A1 | 6/2022 | Chang et al. | |

FOREIGN PATENT DOCUMENTS

| | | | |
|---|---|---|---|
| TW | 201507265 | A | 2/2015 |
| TW | I553962 | B | 10/2016 |
| TW | I736487 | B | 8/2021 |

OTHER PUBLICATIONS

Ku, C.H., et al.; "Compact Planar Triple-Band Folded Dipole Antenna for WLAN/WiMAX Applications;" Progress IN Electromagnetics Research C; vol. 28; Mar. 2012; pp. 1-13.

Chen, H.M., et al.; "Feed for dual-band printed dipole antenna;" Electronics Letters; vol. 40; No. 21; Oct. 2004 pp. 1-2.

Chinese language office action dated Jul. 28, 2022, issued in application No. TW 110137309.

Chinese language office action dated Apr. 25, 2022-, issued in application No. TW 110137309.

* cited by examiner

ANTENNA STRUCTURE AND ELECTRONIC DEVICE

CROSS REFERENCE TO RELATED APPLICATIONS

This application claims priority of Taiwan Patent Application No. 110137309 filed on Oct. 7, 2021, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has narrow operational bandwidth, it will negatively affect the communication quality of the mobile device. Accordingly, it has become a critical challenge for designers to design a wideband antenna structure with a small size.

BRIEF SUMMARY OF THE INVENTION

In an exemplary embodiment, the disclosure is directed to an antenna structure that includes a first radiation element, a second radiation element, a third radiation element, a fourth radiation element, and a fifth radiation element. The first radiation element has a feeding point. The second radiation element is coupled to the feeding point. The second radiation element is at least partially surrounded by the first radiation element. The third radiation element is coupled to a ground voltage. The fourth radiation element is coupled to the third radiation element. The fifth radiation element is coupled to the third radiation element. The fifth radiation element is at least partially surrounded by the third radiation element and the fourth radiation element.

In some embodiments, the antenna structure is a planar antenna structure.

In some embodiments, the antenna structure includes a dielectric substrate. The first radiation element, the second radiation element, the third radiation element, the fourth radiation element, and the fifth radiation element are disposed on the dielectric substrate.

In some embodiments, the antenna structure covers a first frequency band, a second frequency band, a third frequency band, and a fourth frequency band.

In some embodiments, the first frequency band is from 2400 MHz to 2500 MHz, the second frequency band is from 3300 MHz to 4200 MHz, the third frequency band is from 4400 MHz to 5000 MHz, and the fourth frequency band is from 5150 MHz to 7125 MHz.

In some embodiments, the first radiation element substantially has an inverted U-shape.

In some embodiments, the length of the first radiation element is from 0.15 to 0.17 wavelength of the first frequency band.

In some embodiments, the second radiation element includes a terminal bending portion.

In some embodiments, the distance between the first radiation element and the terminal bending portion of the second radiation element is from 2.8 mm to 3.3 mm.

In some embodiments, the length of the second radiation element is from 0.15 to 0.17 wavelength of the fourth frequency band.

In some embodiments, the third radiation element includes a first wide portion and a first narrow portion. The first wide portion is coupled to the ground voltage. The fourth radiation element is coupled through the first narrow portion to the first wide portion.

In some embodiments, the distance between the first radiation element and the first wide portion of the third radiation element is from 2.8 mm to 3.3 mm.

In some embodiments, the fourth radiation element includes a terminal widening portion.

In some embodiments, the combination of the third radiation element and the fourth radiation element substantially has an inverted U-shape.

In some embodiments, the total length of the third radiation element and the fourth radiation element is from 0.15 to 0.17 wavelength of the third frequency band.

In some embodiments, the fifth radiation element substantially has an inverted L-shape.

In some embodiments, the fifth radiation element includes a second wide portion and a second narrow portion. The second narrow portion is coupled through the second wide portion to the third radiation element.

In some embodiments, the distance between the second narrow portion of the fifth radiation element and the first wide portion of the third radiation element is from 3.3 mm to 3.7 mm.

In some embodiments, the total length of the third radiation element and the fifth radiation element is from 0.15 to 0.17 wavelength of the second frequency band.

In another exemplary embodiment, the disclosure is directed to an electronic device that includes an antenna structure as mentioned above and a communication module. The communication module is coupled to the antenna structure, such that the electronic device supports wireless communication.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
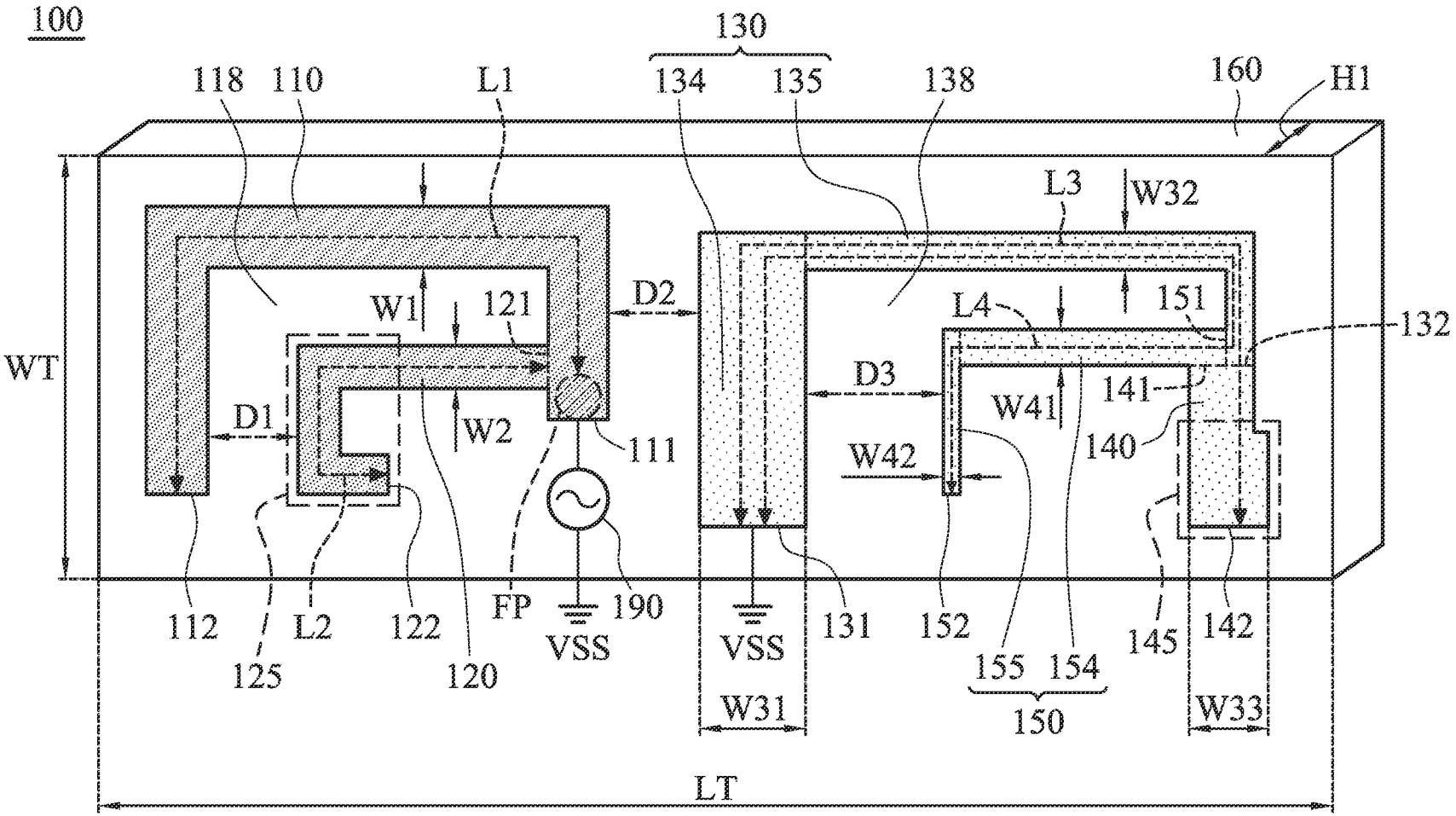
FIG. 1 is a diagram of an antenna structure according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of an antenna structure 100 according to an embodiment of the invention. The antenna structure 100 may be applied to a mobile device, such as a smartphone, a tablet computer, a notebook computer, a wireless access point, a router, or any device for communication. Alternatively, the antenna structure 100 may be applied to an electronic device, such as any unit operating within the Internet of Things (IOT).

As shown in FIG. 1, the antenna structure 100 at least includes a first radiation element 110, a second radiation element 120, a third radiation element 130, a fourth radiation element 140, and a fifth radiation element 150. The first radiation element 110, the second radiation element 120, the third radiation element 130, the fourth radiation element 140, and the fifth radiation element 150 may all be made of metal materials, such as copper, silver, aluminum, iron, or their alloys.

The first radiation element 110 may substantially have an inverted U-shape, and it can define a first notch region 118. Specifically, the first radiation element 110 has a first end 111 and a second end 112. A feeding point FP is positioned at the first end 111 of the first radiation element 110. The second end 112 of the first radiation element 110 is an open end. The feeding point FP may be further coupled to a signal source 190. For example, the signal source 190 may be an RF (Radio Frequency) module for exciting the antenna structure 100.

The second radiation element 120 may substantially have an inverted J-shape, it may be disposed inside the first notch region 118. That is, the second radiation element 120 is at least partially surrounded by the first radiation element 110. Specifically, the second radiation element 120 has a first end 121 and a second end 122. The first end 121 of the second radiation element 120 is coupled to the feeding point FP. The second end 122 of the second radiation element 120 is an open end. In some embodiments, the second radiation element 120 includes a terminal bending portion 125, which is adjacent to the second end 122 of the second radiation element 120. It should be noted that the term "adjacent" or "close" over the disclosure means that the distance (spacing) between two corresponding elements is shorter than a predetermined distance (e.g., 5 mm or shorter), or means that the two corresponding elements are touching each other directly (i.e., the aforementioned distance/spacing therebetween is reduced to 0). For example, the terminal bending portion 125 of the second radiation element 120 may substantially have a C-shape. In addition, the width W2 of the second radiation element 120 may be smaller than the width W1 of the first radiation element 110.

The third radiation element 130 may substantially have an inverted L-shape, and it may be completely separate from the first radiation element 110 and the second radiation element 120. Specifically, the third radiation element 130 has a first end 131 and a second end 132. The first end 131 of the third radiation element 130 is coupled to a ground voltage VSS. For example, the ground voltage VSS may be provided by a system ground plane (not shown) of the antenna structure 100. In some embodiments, the third radiation element 130 is a variable-width structure, and includes a first wide portion 134 adjacent to the first end 131 and a first narrow portion 135 adjacent to the second end 132. The first wide portion 134 is coupled to the ground voltage VSS. The fourth radiation element 140 is coupled through the first narrow portion 135 to the first wide portion 134.

The fourth radiation element 140 may substantially have a straight-line shape, and it may be substantially parallel to the first wide portion 134 of the third radiation element 130. The combination of the third radiation element 130 and the fourth radiation element 140 may substantially have an inverted U-shape, which can define a second notch region 138. Specifically, the fourth radiation element 140 has a first end 141 and a second end 142. The first end 141 of the fourth radiation element 140 is coupled to the second end 132 of the third radiation element 130. The second end 142 of the fourth radiation element 140 is an open end. In some embodiments, the fourth radiation element 140 includes a terminal widening portion 145, which is adjacent to the second end 142 of the fourth radiation element 140.

The fifth radiation element 150 may substantially have an inverted L-shape, and it may be disposed inside the second notch region 138. That is, the fifth radiation element 150 is at least partially surrounded by the third radiation element 130 and the fourth radiation element 140. Specifically, the fifth radiation element 150 has a first end 151 and a second end 152. The first end 151 of the fifth radiation element 150 is coupled to the second end 132 of the third radiation element 130. The second end 152 of the fifth radiation element 150 is an open end. For example, the second end 142 of the fourth radiation element 140 and the second end 152 of the fifth radiation element 150 may substantially extend in the same direction. In some embodiments, the fifth radiation element 150 is another variable-width structure, and includes a second wide portion 154 adjacent to the first end 151 and a second narrow portion 155 adjacent to the second end 152. The second narrow portion 155 is coupled through the second wide portion 154 to the third radiation element 130.

In some embodiments, the antenna structure 100 further includes a dielectric substrate 160. For example, the dielectric substrate 160 may be an FR4 (Flame Retardant 4) substrate, a PCB (Printed Circuit Board), or an FPC (Flexible Printed Circuit). The first radiation element 110, the second radiation element 120, the third radiation element 130, the fourth radiation element 140, and the fifth radiation element 150 may be disposed on the same surface of the dielectric substrate 160. Thus, the antenna structure 100 may be a planar antenna structure. However, the invention is not limited thereto. In alternative embodiments, the first radiation element 110, the second radiation element 120, the third radiation element 130, the fourth radiation element 140, and the fifth radiation element 150 may be disposed on different surfaces of a nonconductive support element, so as to form a 3D (Three-Dimensional) antenna structure.

Figure 2:
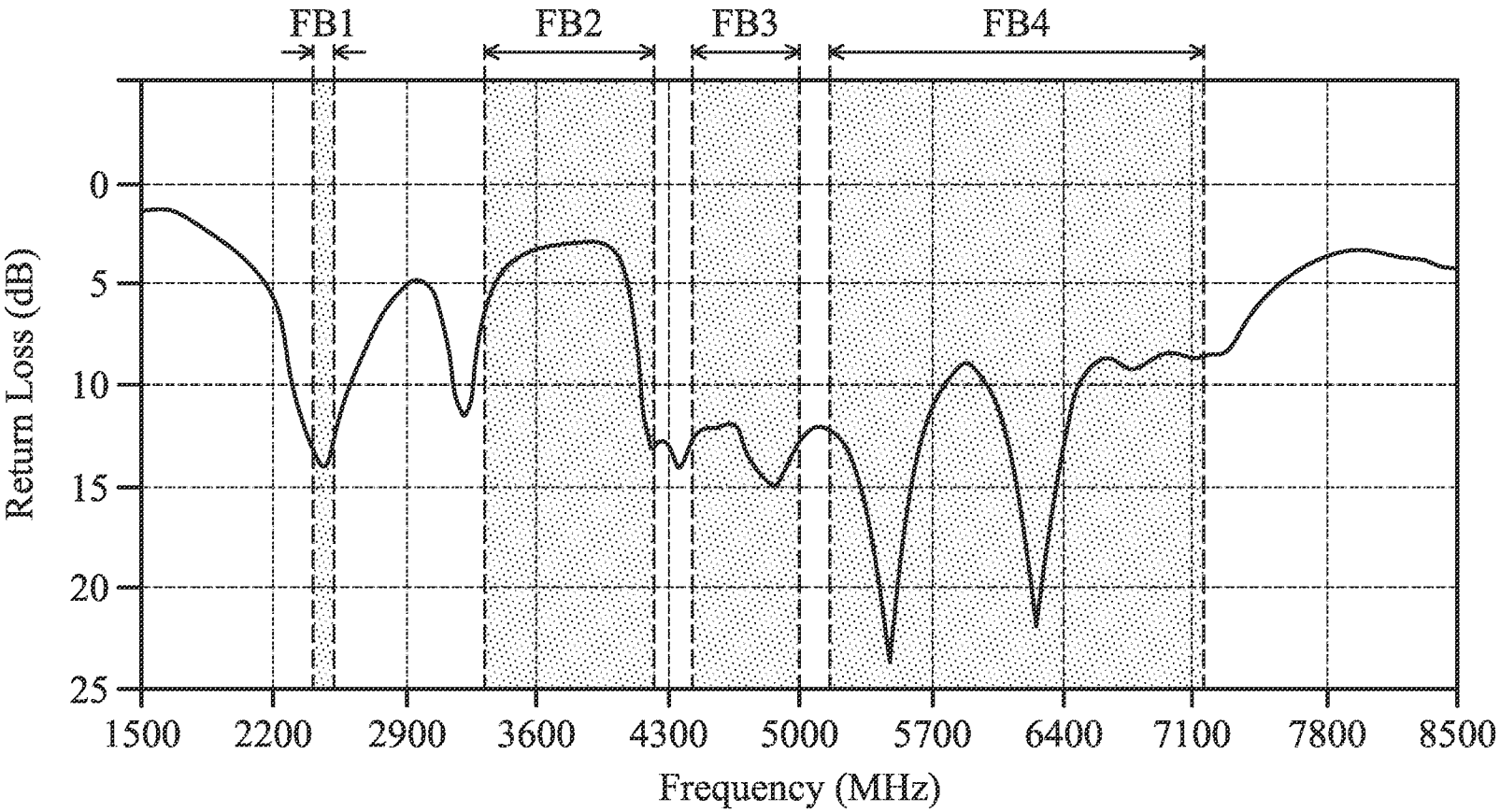
FIG. 2 is a diagram of return loss of an antenna structure according to an embodiment of the invention.

FIG. 2 is a diagram of return loss of the antenna structure 100 according to an embodiment of the invention. The horizontal axis represents the operational frequency (MHz), and the vertical axis represents the return loss (dB). According to the measurement of FIG. 2, the antenna structure 100 can cover a first frequency band FB1, a second frequency band FB2, a third frequency band FB3, and a fourth frequency band FB4. For example, the first frequency band FB1 may be from 2400 MHz to 2500 MHz, the second frequency band FB2 may be from 3300 MHz to 4200 MHz, the third frequency band FB3 may be from 4400 MHz to 5000 MHz, and the fourth frequency band FB4 may be from 5150 MHz to 7125 MHz. Accordingly, the antenna structure 100 can support at least the wideband operations of the next-generation 5G ($5^{th}$ General Mobile Networks) communication and Wi-Fi 6E.

In some embodiments, the operational principles of the antenna structure 100 will be described as follows. The first radiation element 110 can be excited to generate the first frequency band FB1 of the antenna structure 100. The second radiation element 120 can be excited to generate the fourth frequency band FB4 of the antenna structure 100. The third radiation element 130 and the fourth radiation element 140 can be excited to generate the third frequency band FB3 of the antenna structure 100. The third radiation element 130 and the fifth radiation element 150 can be excited to generate the second frequency band FB2 of the antenna structure 100. According to practical measurements, the terminal bending portion 125 of the second radiation element 120 can increase the operational bandwidth of the fourth frequency band FB4. The variable-width structure of the third radiation element 130 can increase the radiation efficiency of the second frequency band FB2 and the third frequency band FB3. The variable-width structure of the fifth radiation element 150 can increase the radiation efficiency of the second frequency band FB2. It should be noted that the total size of the antenna structure 100 can be effectively reduced since all of the radiation elements corresponding to 5G communication and Wi-Fi 6E are integrated in the single antenna structure 100.

Figure 3:
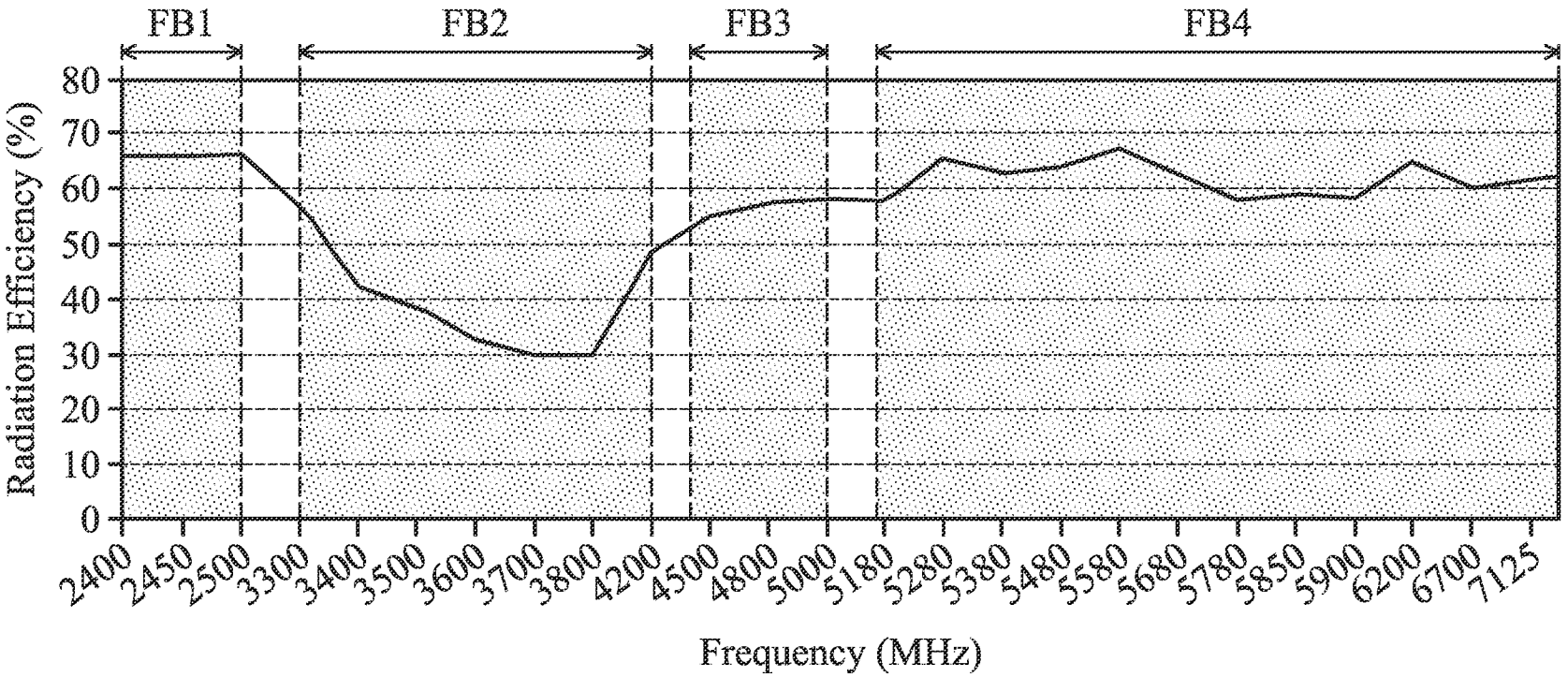
FIG. 3 is a diagram of radiation efficiency of an antenna structure according to an embodiment of the invention.

FIG. 3 is a diagram of radiation efficiency of the antenna structure 100 according to an embodiment of the invention. The horizontal axis represents the operational frequency (MHz), and the vertical axis represents the radiation efficiency (%). According to the measurement of FIG. 3, the radiation efficiency of the antenna structure 100 can be higher than 30% over the first frequency band FB1, the second frequency band FB2, the third frequency band FB3, and the fourth frequency band FB4. It can meet the requirements of practical applications of general communication systems.

In some embodiments, the element sizes of the antenna structure 100 will be described as follows. The length L1 of the first radiation element 110 may be from 0.15 to 0.17 wavelength (0.15λ~0.17λ) of the first frequency band FB1 of the antenna structure 100. The width W1 of the first radiation element 110 may be from 1.2 mm to 2.1 mm. The length L2 of the second radiation element 120 may be from 0.15 to 0.17 wavelength (0.15λ~0.17λ) of the fourth frequency band FB4 of the antenna structure 100. The width W2 of the second radiation element 120 may be from 0.8 mm to 1.2 mm. The total length L3 of the third radiation element 130 and the fourth radiation element 140 may be from 0.15 to 0.17 wavelength (0.15λ~0.17λ) of the third frequency band FB3 of the antenna structure 100. In the third radiation element 130, the width W31 of the first wide portion 134 may be from 2.8 mm to 3.5 mm, and the width W32 of the first narrow portion 135 may be from 0.8 mm to 1.2 mm. The width W33 of the terminal widening portion 145 of the fourth radiation element 140 may be from 1.4 mm to 2 mm. The total length L4 of the third radiation element 130 and the fifth radiation element 150 may be from 0.15 to 0.17 wavelength (0.15λ~0.17λ) of the second frequency band FB2 of the antenna structure 100. In the fifth radiation element 150, the width W41 of the second wide portion 154 may be from 0.8 mm to 1.2 mm, and the width W42 of the second narrow portion 155 may be from 0.6 mm to 1 mm. The thickness H1 of the dielectric substrate 160 may be from 0.4 mm to 0.6 mm. The dielectric constant of the dielectric substrate 160 may be from 4 to 5. The distance D1 between the first radiation element 110 and the terminal bending portion 125 of the second radiation element 120 may be form 2.8 mm to 3.3 mm. The distance D2 between the first radiation element 110 and the first wide portion 134 of the third radiation element 130 may be from 2.8 mm to 3.3 mm. The distance D3 between the first wide portion 134 of the third radiation element 130 and the second narrow portion 155 of the fifth radiation element 150 may be from 3.3 mm to 3.7 mm. The total length LT of the antenna structure 100 may be shorter than or equal to 30 mm. The total width WT of the antenna structure 100 may be shorter than or equal to 10 mm. The above ranges of element sizes are calculated and obtained according to many experimental results, and they can help to optimize the operational bandwidth and impedance matching of the antenna structure 100.

Figure 4:
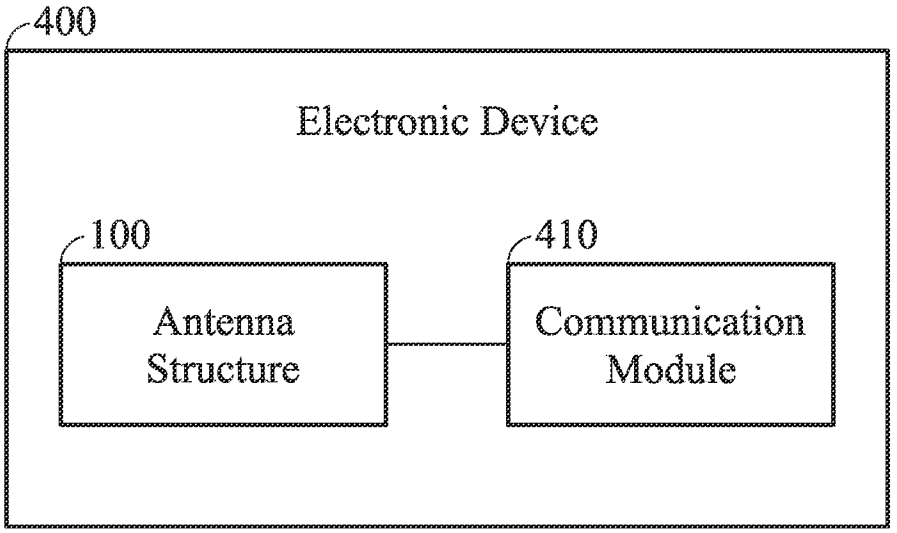
FIG. 4 is a diagram of an electronic device according to an embodiment of the invention.

FIG. 4 is a diagram of an electronic device 400 according to an embodiment of the invention. The electronic device 400 can be applied to an IOT. As shown in FIG. 4, the electronic device 400 includes an antenna structure 100 and a communication module 410. All of the features of the antenna structure 100 have been described in the embodiments of FIGS. 1 to 3. On the other hand, the communication module 410 is coupled to the antenna structure 100, such that the electronic device 400 can support wireless communication. For example, the communication module 410 may include a signal source, an RF circuit, a filter, an amplifier, and/or a processor, but it is not limited thereto. In the embodiment of the invention, the communication module 410 can support both of WLAN (Wireless Local Area Network) service and WWAN (Wireless Wide Area Network) service, but it is not limited thereto. Other features of the electronic device 400 of FIG. 4 are similar to those of the antenna structure 100 of FIG. 1. Therefore, the two embodiments can achieve similar levels of performance. In another embodiment of the invention, the electronic device 400 includes an antenna structure 100, a first communication module, and a second communication module (not shown). The first communication module supports WLAN service. The second communication module supports WWAN service. The antenna structure 100 is coupled/connected to the first communication module and the second communication module, respectively.

The invention proposes a novel antenna structure and a novel electronic device. In comparison to the conventional design, the invention has at least the advantages of small size, wide bandwidth, and low manufacturing cost, and therefore it is suitable for application in a variety of mobile communication devices or IOT.

Note that the above element sizes, element shapes, element parameters, and frequency ranges are not limitations of the invention. An antenna designer can fine-tune these settings or values according to different requirements. It should be understood that the antenna structure and electronic device of the invention are not limited to the configurations of FIGS. 1-4. The invention may merely include any one or more features of any one or more embodiments of FIGS. 1-4. In other words, not all of the features displayed in the figures should be implemented in the antenna structure and electronic device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a first radiation element, having a feeding point;

a second radiation element, coupled to the feeding point, wherein the second radiation element is at least partially surrounded by the first radiation element;

a third radiation element, coupled to a ground voltage;

a fourth radiation element, coupled to the third radiation element; and a fifth radiation element, coupled to the third radiation element, wherein the fifth radiation element is at least partially surrounded by the third radiation element and the fourth radiation element;

wherein the antenna structure covers a first frequency band, a second frequency band, a third frequency band, and a fourth frequency band;

wherein a length of the first radiation element is from 0.15 to 0.17 wavelength of the first frequency band;

wherein the second radiation element comprises a terminal bending portion;

wherein a distance between the first radiation element and the terminal bending portion of the second radiation element is from 2.8 mm to 3.3 mm.

2. The antenna structure as claimed in claim 1, wherein the antenna structure is a planar antenna structure.

3. The antenna structure as claimed in claim 1, further comprising:

a dielectric substrate, wherein the first radiation element, the second radiation element, the third radiation element, the fourth radiation element, and the fifth radiation element are disposed on the dielectric substrate.

4. The antenna structure as claimed in claim 1, wherein the first frequency band is from 2400 MHz to 2500 MHz, the second frequency band is from 3300 MHz to 4200 MHz, the third frequency band is from 4400 MHz to 5000 MHz, and the fourth frequency band is from 5150 MHz to 7125 MHz.

5. The antenna structure as claimed in claim 1, wherein the first radiation element substantially has an inverted U-shape.

6. The antenna structure as claimed in claim 1, wherein a length of the second radiation element is from 0.15 to 0.17 wavelength of the fourth frequency band.

7. The antenna structure as claimed in claim 1, wherein the third radiation element comprises a first wide portion and a first narrow portion, the first wide portion is coupled to the ground voltage, and the fourth radiation element is coupled through the first narrow portion to the first wide portion.

8. The antenna structure as claimed in claim 7, wherein a distance between the first radiation element and the first wide portion of the third radiation element is from 2.8 mm to 3.3 mm.

9. The antenna structure as claimed in claim 7, wherein the fifth radiation element comprises a second wide portion and a second narrow portion, and the second narrow portion is coupled through the second wide portion to the third radiation element.

10. The antenna structure as claimed in claim 9, wherein a distance between the second narrow portion of the fifth radiation element and the first wide portion of the third radiation element is from 3.3 mm to 3.7 mm.

11. The antenna structure as claimed in claim 1, wherein the fourth radiation element comprises a terminal widening portion.

12. The antenna structure as claimed in claim 1, wherein a combination of the third radiation element and the fourth radiation element substantially has an inverted U-shape.

13. The antenna structure as claimed in claim 1, wherein a total length of the third radiation element and the fourth radiation element is from 0.15 to 0.17 wavelength of the third frequency band.

14. The antenna structure as claimed in claim 1, wherein the fifth radiation element substantially has an inverted L-shape.

15. The antenna structure as claimed in claim 1, wherein a total length of the third radiation element and the fifth radiation element is from 0.15 to 0.17 wavelength of the second frequency band.

16. An electronic device, comprising:

an antenna structure as claimed in claim 1; and a communication module, coupled to the antenna structure, such that the electronic device supports wireless communication.

* * * * *